US007694373B2

(12) United States Patent
Kwon et al.

(10) Patent No.: US 7,694,373 B2
(45) Date of Patent: Apr. 13, 2010

(54) CONTROL METHOD FOR SPINNING CYCLE IN WASHING MACHINE

(75) Inventors: Ig Geun Kwon, Changwon-si (KR); Dong Won Kang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 862 days.

(21) Appl. No.: 11/496,027

(22) Filed: Jul. 31, 2006

(65) Prior Publication Data

US 2007/0124871 A1 Jun. 7, 2007

(30) Foreign Application Priority Data

Aug. 1, 2005 (KR) ..... 10-2005-0070172
Aug. 1, 2005 (KR) ..... 10-2005-0070174

(51) Int. Cl.
*D06F 33/02* (2006.01)
*D06F 35/00* (2006.01)

(52) U.S. Cl. ..... 8/158

(58) Field of Classification Search ..... 8/158–159
See application file for complete search history.

(56) References Cited

U.S. PATENT DOCUMENTS

2002/0046581 A1* 4/2002 Shimakage et al. ..... 68/12.04
2005/0016227 A1 1/2005 Lee
2005/0188473 A1* 9/2005 Son et al. ..... 8/159
2005/0283919 A1* 12/2005 Kim ..... 8/158

FOREIGN PATENT DOCUMENTS

DE 10 2005 003 695 7/2007
GB 1562777 A * 3/1980

* cited by examiner

*Primary Examiner*—Joseph L Perrin
(74) *Attorney, Agent, or Firm*—McKenna Long & Aldridge LLP

(57) ABSTRACT

A control method for a spinning cycle in a washing machine is disclosed. The control method for a spinning cycle in a washing machine includes (a) step of performing a water-draining by rotating a motor at a predetermined speed lower than a resonance generation speed and (b) step of performing a main-spinning by rotating the motor at a speed higher than the resonance generation speed. The control method for a spinning cycle in a washing machine according to the present invention has an advantageous effect that over-vibration caused by unbalance may be controlled and that remaining water within the drum is drained smoothly and vibration/noise of a washing machine is minimized.

10 Claims, 3 Drawing Sheets

CONTROL METHOD FOR SPINNING CYCLE IN WASHING MACHINE

This application claims the benefit of the Patent Korean Application Nos. P2005-70172 and No. P2005-70174, filed on Aug. 1, 2005, which are hereby incorporated by reference as if fully set forth herein.

BACKGROUND OF THE INVENTION

1. Field of the Invention

The present invention relates to a washing machine, more particularly, to a control method a spinning cycle in a washing machine which can minimize over-vibration generated in a spinning cycle and can enhance drainage and dehydration capability.

2. Discussion of the Related Art

In general, a washing machine is an electric appliance used most commonly in a house. The washing machine washes cloth items, clothes and beddings (hereinafter, the laundry) by using friction poser of wash water current generated by rotation movement and shock power with the laundry, in a state where wash water, detergent and the laundry are mixedly loaded into a drum.

The washing machine is classified into a pulstor type washing machine having a drum vertically installed therein and a drum type washing machine having a drum horizontally installed therein, and performs washing by means of a washing algorithm including a washing, rinsing and spinning cycle.

Commonly, in a washing cycle, detergent, wash water and the laundry are loaded in the washing machine and dirt of the laundry is removed by chemical action of detergent and physical action of a drum.

In a rinsing cycle, wash water not mixed with detergent is supplied and detergent and dirt remaining on the laundry may be rinsed.

Finally, in a spinning cycle, a drum is spinned at a high speed to dehydrate the laundry after a rinsing cycle is completed.

As describing a spinning cycle more specifically, first of all, water is drained and a laundry-balancing is performed where a motor repeatedly rotates a drum in a clockwise/counter-clockwise direction to prevent the laundry from being entangled.

After the laundry-balancing, a dehydrating, in other words, a high speed spinning is performed by increasing RPM of the motor in a predetermined direction to remove moisture contained in the laundry.

If the laundry is not uniformly distributed during the spinning cycle, there might be unbalance of the laundry. Thus, it is needed to sense the RPM of the motor in a beginning of a spinning cycle, such that vibration or unbalance of a body may be sensed by variation of RPM.

Here, once the laundry unbalance is determined more than an allowable range, the drum is stopped and re-rotated. Once the laundry unbalance is determined less than an allowable range, the RPM of motor is increased gradually.

That is, in case the drum is rotated in more than the allowable range of laundry unbalance in the beginning of the spinning cycle, there may be bad influence on entire rigidity of the system. Thus, it is preferred to start the high speed spinning after limiting the laundry unbalance less than the allowable range.

However, a spinning cycle according to the related art senses laundry unbalance only once when accelerating the motor before starting a high speed spinning, thereby resulting in mal-sensing of laundry unbalance.

Especially, in case that laundry unbalance is mal-sensed in a spinning cycle at 200~300 RPM in that resonance is generated, severe vibration is generated enough to cause damage such as glass scratch of a door or washing machine moving.

Also, since water leaked from the laundry by centrifugal force may be stuck to a wall of the drum after a predetermined RPM of high speed spinning according to the related art, normal drainage may not be performed.

Thus, the remaining water within the drum may be a cause of severe vibration or noise in a high speed spinning, thereby resulting in customer dissatisfaction.

SUMMARY OF THE INVENTION

Accordingly, the present invention is directed to a control method for a spinning cycle in a washing machine.

An object of the present invention is to provide a control method for a spinning cycle in a washing machine which can minimize over-vibration generated in a spinning cycle and can enhance drainage and dehydration capability.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention., as embodied and broadly described herein, a method for a spinning cycle in a washing machine includes: (a) step of performing a water-draining by rotating a motor at a predetermined speed lower than a resonance generation speed; and (b) step of performing a main-spinning by rotating the motor at a speed higher than the resonance generation speed.

In another aspect of the present invention, a method for a spinning cycle in a washing machine includes: (a) step of performing a water-draining by rotating a motor at a predetermined speed lower than a resonance generation speed; (b) step of performing a main-spinning, where the motor is rotated at a high speed, by rotating the motor at a speed higher than the resonance generation speed; and (c) step of decelerating the rotation speed of the motor at the beginning of main-spinning to a speed lower than the resonance generation speed and re-starting the main-spinning.

A step of performing a laundry-balancing for alternatively rotating the motor in a clockwise/counter-clockwise direction at a first predetermined speed before the water-draining of (a) step is further included.

Preferably, during the water-draining of (a) step the motor is rotated at a second predetermined speed higher than the first predetermined speed and lower than the resonance generation speed.

The water-draining of (a) step may be performed at least once after the laundry-balancing.

The laundry-balancing and the water-draining may be performed alternatively at least twice before the main-spinning of (b) step.

The water-draining of (a) step includes a first-water-draining for rotating the motor at the second predetermined speed in a clockwise direction, the second predetermined speed which is higher than the first predetermined speed and lower than the resonance generation speed; and a second-water-draining for rotating the motor at a third predetermined speed in a clockwise direction, the third predetermined speed which is higher than the second predetermined speed and lower than the resonance generation speed.

The laundry-balancing is performed before the first-water-draining and the second-water-draining, and the first-water-draining is performed once after the laundry-balancing and the second-water-draining is performed repeatedly at least twice after the laundry-balancing.

The present invention further includes a step of sensing an amount of motor unbalance during the water-draining, and a step of stopping the spinning cycle if the sensed amount of motor unbalance is more or less than a predetermined allowable range.

The present invention further includes steps of: repeatedly performing the water-draining predetermined times as much as more than at least twice, sensing an amount of motor unbalance whenever the water-draining is performed, calculating an average value of the sensed amount of motor unbalance after the water-draining is performed predetermined times, and stopping the spinning cycle if the average value is more or less the predetermined allowable range.

The (b) and (C) step includes steps of first-main-spinning for rotating the motor to a predetermined first spinning speed if the main-spinning starts, decelerating the rotation speed of the motor below the resonance generation speed to drain the water discharged in the step of first-main-spinning at the moment when the predetermined time passes, and re-performing the water-draining and re-performing the water-draining, and second-main-spinning for re-accelerating the rotation speed of the motor to the second predetermined spinning speed once the motor is decelerated below the resonance generation speed.

Preferably, the second spinning speed is higher than the first spinning speed.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
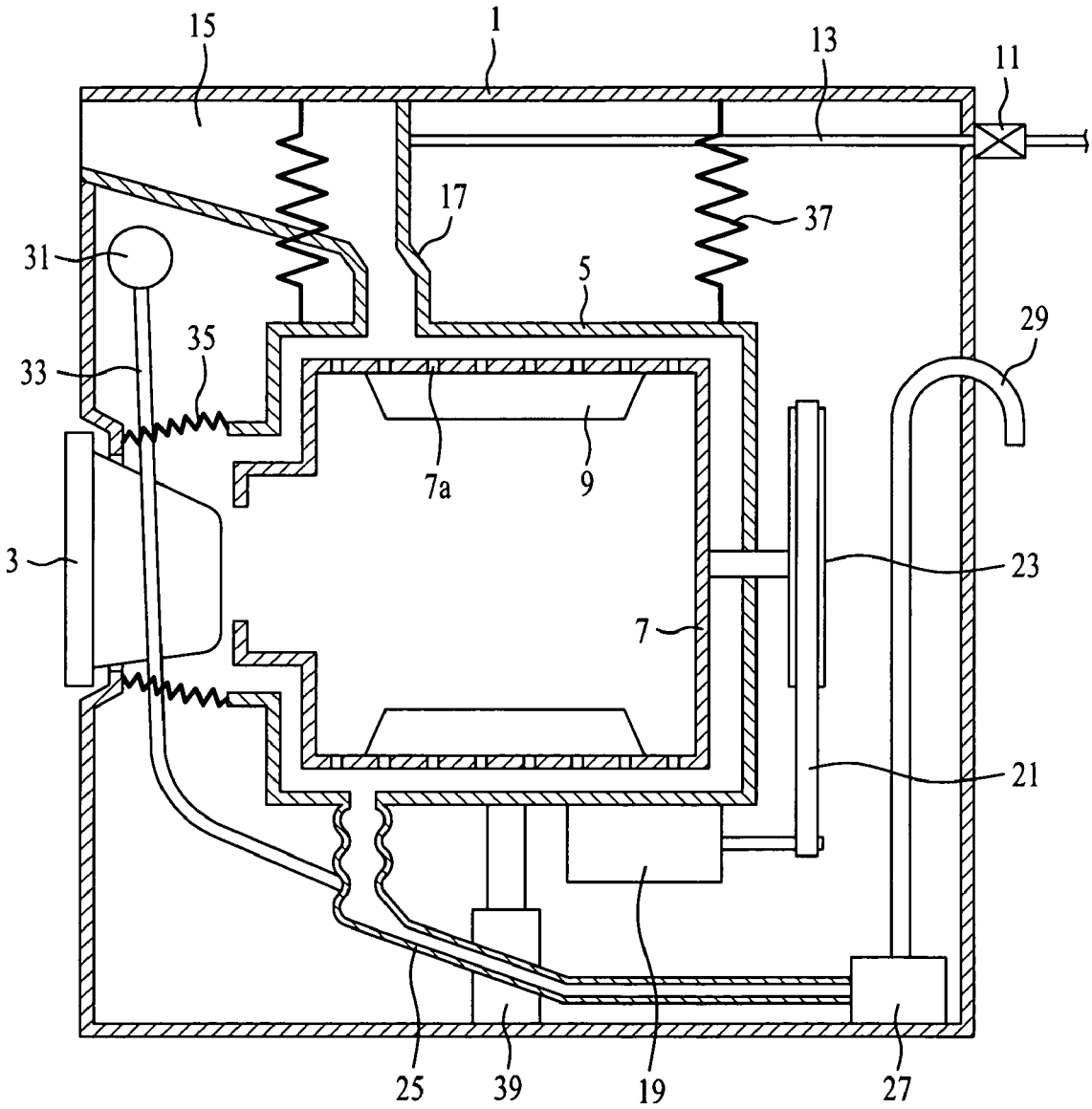
FIG. 1 is a sectional view illustrating a convention drum type washing machine to apply a control method for a spinning cycle according to the present invention.

Referring to FIG. 1, a conventional drum type washing machine to which a spinning algorithm of the present invention may be applied.

The conventional drum type washing machine includes an outer case 1 for defining an exterior thereof, a door 3 rotatably coupled to a front surface of the outer case 1 to load/unload the laundry smoothly.

A tub 5 is mounted within the outer case 1 to hold wash water performing washing. A drum 7 is rotatably mounted within the tub 5 and has plural spinning holes 7*a* formed on a surface thereof to drain water of the laundry when the drum is rotated at a high speed.

A lifter 9 is mounted in a side of a drum inside to lift the laundry to a predetermined height and drop the laundry by gravity. A water supply valve 11 and a water supply hose 13 are provided in a side of the outer case 1 to supply water needed in washing.

A detergent drawer 15 is provided in an upper portion of the outer case 1 to introduce detergent and fabric softener. A water supply bellows 17 is mounted in a side of the detergent drawer 15 and the tub 5 to supply mixture of wash water and detergent draw into the detergent drawer 15 through the water supply hose 13 to the tub 5 and to be elastically connected with the tub 5.

A motor 19 is mounted in a side of the tub 5 to generate a driving force, and a belt 21 and a pulley 23 are provided in a side of the motor to transmit the rotation force of the motor 19 to rotate the drum in a clockwise/counter-clockwise direction.

A water drainage bellows 25 is mounted in a lower portion of the tub 5 to drain the contaminated water which has completed washing. A water drainage pump 27 is mounted in a side of the water drainage bellows 25 to pump the water drained through the water drainage bellows 25. Also, a water drainage hose 29 is provided in a side of the water drainage pump 27 to discharge the water pumped through the water drainage pump 27 outside.

A water level sensor 31 is provided in the outer case 1 for sensing a water level based on water pressure to determine whether water is supplied within the tub 5, and a water level sensor hose 33 is provided for transmitting the water pressure of the tub 5 to the water level sensor 31. Also, a gasket 35 is provided between the tub 5 and the door 3 to prevent the water held in the tub 5 from being leaked.

A spring 37 is provided to absorb vibration generated in an upper portion of the tub 5 and a damper 39 is provided to support a lower portion of the tub 5 and to dampen the vibration.

Applying a control method for a spinning cycle according to the present invention to the drum type washing machine with the above configuration, an algorithm thereof will be described.

Figure 2:
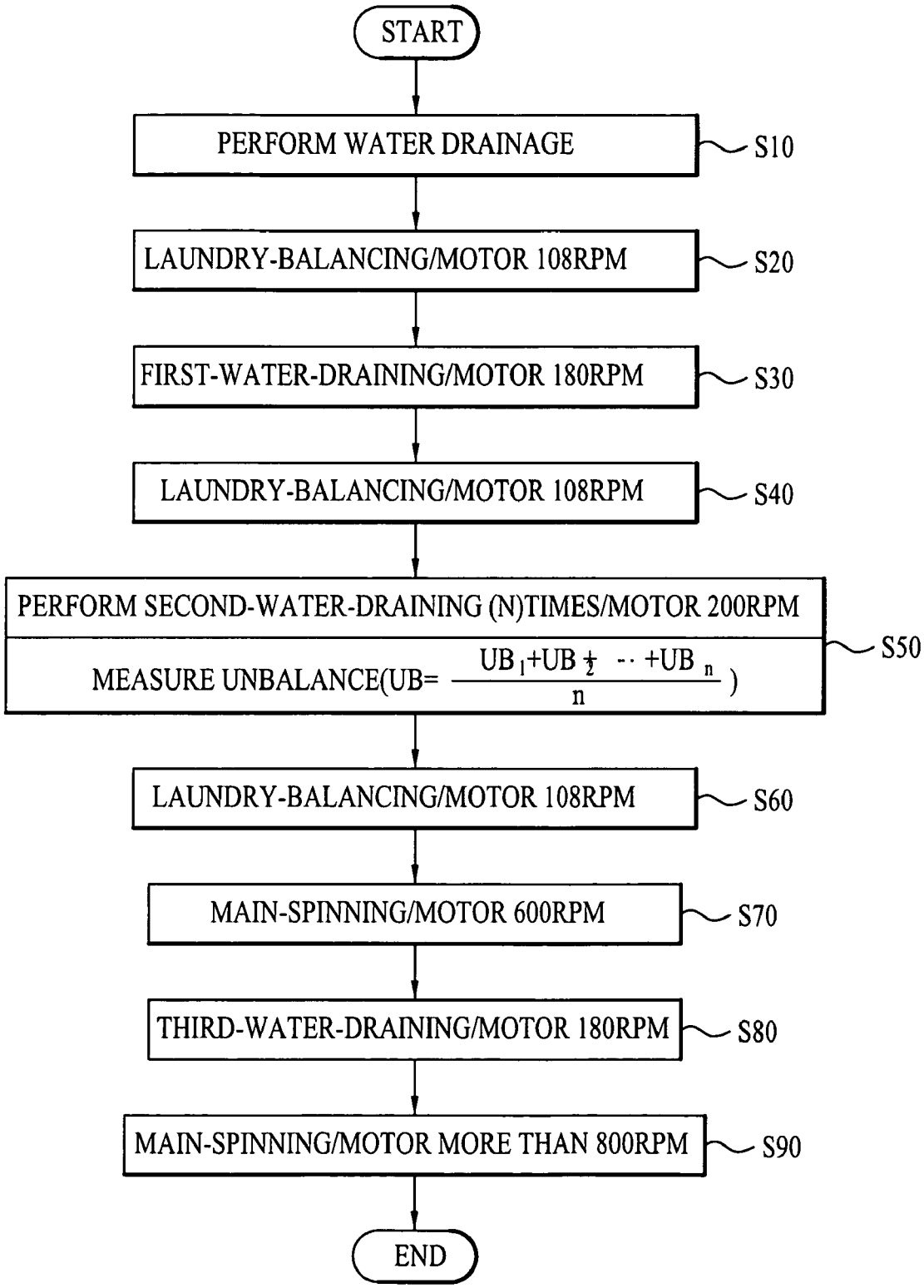
FIG. 2 is a flow chart illustrating a method for controlling a spinning cycle in a washing machine according to the present invention.
Figure 3:
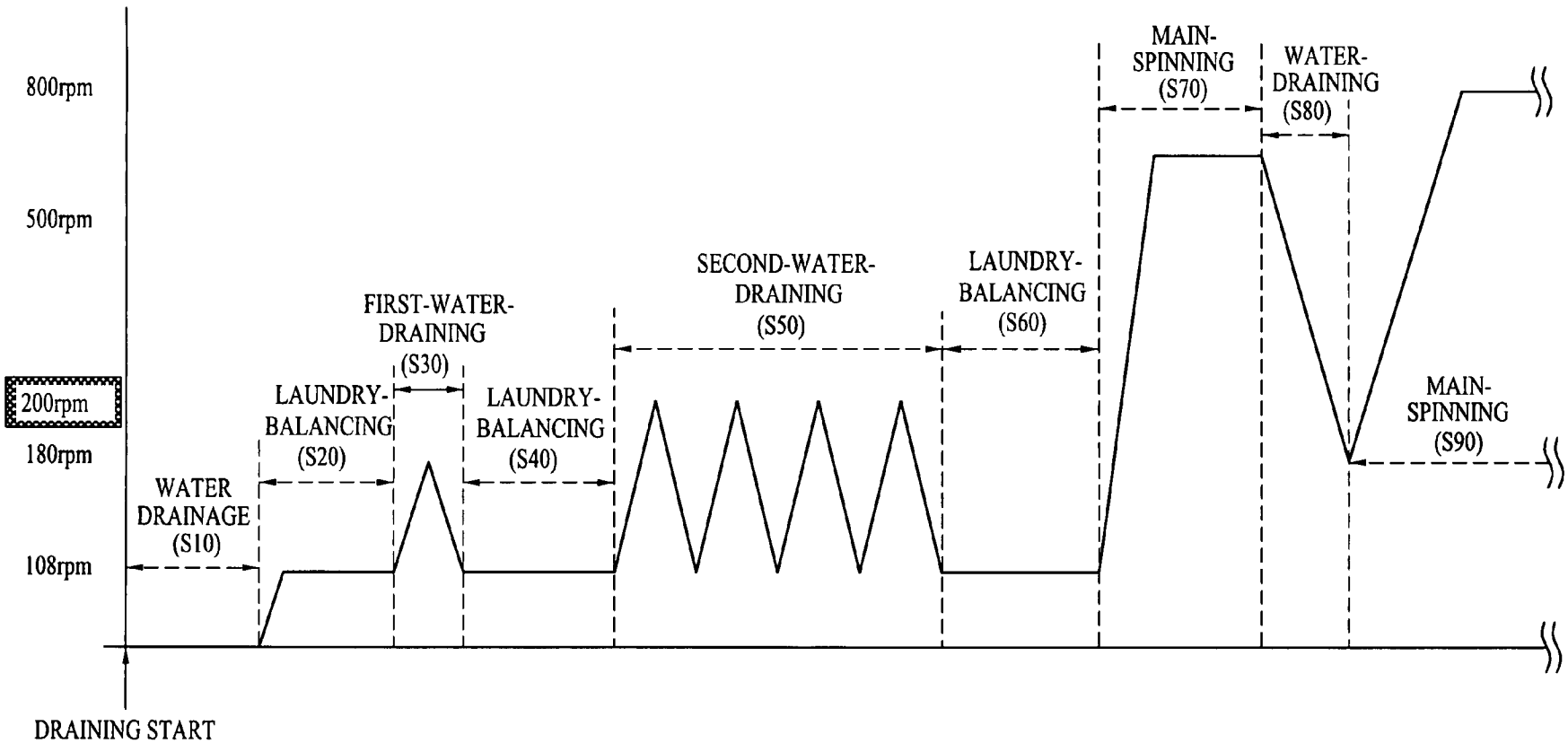
FIG. 3 is a graph illustrating a motor control speed of the spinning cycle according to the present invention.

Referring to FIGS. 2 and 3, a control method for a spinning cycle according to the present invention will be described.

A distinguishable technical feature of the present invention is that a water-draining is repeatedly performed below a resonance generation speed (that is, more than 300 RPM) before starting a main-spinning and that laundry unbalance is evaluated by an average value of the laundry unbalance amount repeatedly sensed during the water draining.

Here, the speed and frequency of the water-draining may be selected based on a kind of a washing machine or a system.

Another distinguishable technical feature of the present invention is that the rotation of the motor 19 is temporarily decelerated to remove the water discharged while reaching a predetermined RPM in a high speed spinning.

First of all, once a spinning cycle starts, the water drainage pump 27 is operated to completely drain water held within the drum 7 (S10).

According to the present invention, a laundry-balancing and a water-draining are performed before a main-spinning starts.

More specifically, once water drainage is completed, the motor 19 is repeatedly rotated at 100 RPM~110 RPM (preferably, 108 RPM) in a clockwise/counter-clockwise direction to prevent the laundry from being entangled as well as to keep drum balance (S20).

Next, once the laundry-balancing (S20) is completed, the motor 19 is rotated at 180 RPM in one direction to perform a first-water-draining for removing moisture contained in the laundry (S30).

Hence, once the first-water-draining (S30) is completed, the rotation speed of the motor 19 is decelerated to 108 RPM and the motor 19 is repeatedly rotated in a clockwise/counter-clockwise direction to re-perform a laundry-balancing (S40).

Once the laundry-balancing (S40) is completed, the motor is acceleratedly rotated at 200 RpM to repeatedly perform a second-water-draining for removing moisture contained in the laundry for a predetermined times (S50).

At that time, it is preferred that the rotation speed of the motor 19 is below the resonance generation speed (200~300 RPM) during the first and second water draining. Preferably, the rotation speed of the first-water-draining is higher than that of the second water draining.

Also, preferably the second-water-draining is predetermined to be performed at least more than four times based on a system.

During the process of accelerating the rotation speed of the motor in the first and second water draining, the difference of RPM is evaluated to sense vibration of a washing machine or an unbalance condition (that is, a laundry unbalance amount).

Here, whenever the second-water-draining is repeated for the predetermined times (N times), the laundry unbalance amount (UB1, UB2 . . . and UBN) is sensed and the average value (UB=(UB1+UB2+ . . . +UBN)/N) for every laundry unbalance amount is evaluated.

Hence, if the laundry unbalance amount (UB) sensed in the second-water-draining is more or less than a predetermined range, the spinning cycle put into operation is stopped. If the laundry unbalance amount (UB) is in the predetermined range, the rotation speed of the motor 19 is decelerated to 108 RpM to re-perform a laundry-balancing (S60).

Once the laundry-balancing (S60) is completed, the motor 19 is rotated at a high speed to perform a main-spinning. First of all, the rotation speed of the motor 19 is accelerated to 600 RPM and the speed of 600 RPM is maintained for a predetermined time period (S70).

At that time, the drum 7 which has received the rotation force of the motor 19 is rotated at a high speed to make the moisture of the laundry extracted by a centrifugal force drawn into the water drainage pump 27. Thus, the moisture drawn into the water drainage pump 27 is drained by the regular operation of the water drainage pump 27, thereby performing a spinning cycle.

According to the present invention, a third-water-draining is performed (S80) where the rotation speed of the motor is decelerated to 180 RPM to efficiently discharge the water extracted from the laundry during the above process (S70). That is, the water generated at the speed of 600 RPM during the main-spinning may be drained smoothly due to the deceleration of the spinning speed.

hence, once the rotation speed of the motor 19 reaches 180 RPM, the rotation speed of the motor 19 is gradually accelerated to a high speed (800~1300 RPM). Thus, a main-spinning cycle is performed (S90).

The control method for a spinning cycle in a washing machine according to the present invention has following advantageous effects.

First, the control method for a spinning cycle in a washing machine according to the present invention has an advantageous effect that product reliability deterioration due to unbalance mal-sensing may be minimized, because unbalance sensing is repeated many times before a main-spinning starts.

Second, the control method for a spinning cycle in a washing machine according to the present invention has another advantageous effect that over-vibration caused by unbalance may be controlled, because the water-draining is performed below the resonance generation speed to keep laundry balance before a main-spinning starts.

Third, the control method for a spinning cycle in a washing machine according to the present invention has still another advantageous effect that remaining water within the drum is drained smoothly and vibration/noise of a washing machine is minimized, because the rotation speed of the motor is temporarily decelerated during the main-spinning to remove water discharged while the rotation speed of the motor reaches a predetermined speed in a high spinning.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for a spinning cycle in a washing machine comprising:

(a) step of performing a water-draining by rotating a motor at a predetermined speed lower than a resonance generation speed;

(b) step of performing a main-spinning, where the motor is rotated at a high speed, by rotating the motor at a speed higher than the resonance generation speed; and (c) step of decelerating the rotation speed of the motor at the beginning of main-spinning to a speed lower than the resonance generation speed and re-starting the main-spinning, and wherein steps (b) and (c) comprise the steps of:

first-main-spinning for rotating the motor to a predetermined first spinning speed higher than the resonance generation speed if the main-spinning starts;

decelerating the rotation speed of the motor lower the resonance generation speed to drain the water discharged in the step of first-main-spinning at the moment when the predetermined time passes;

second-main-spinning for re-accelerating the rotation speed of the motor to the second predetermined spinning speed higher than the resonance generation speed once the motor is decelerated lower the resonance generation speed.

2. The method for a spinning cycle in a washing machine of 1, further comprising a step of performing a laundry-balancing where the motor is alternatively rotated at a first predetermined speed in a clockwise/counter-clockwise direction before the water-draining of (a) step.

3. The method for a spinning cycle in a washing machine of 2, wherein in the water-draining of (a) step the motor is rotated at a second predetermined speed in a clockwise direction, the second predetermined speed which is higher than the first predetermined speed and lower than the resonance generation speed.

4. The method for a spinning cycle in a washing machine of 2, wherein the water-draining of (a) step is repeatedly performed at least once after the laundry-balancing.

5. The method for a spinning cycle in a washing machine of 2, wherein the laundry-balancing and the water-draining is alternatively performed at least twice before the main-spinning of (b) step.

6. The method for a spinning cycle in a washing machine of 2, wherein the water-draining of (a) step comprises:

a first-water-draining where the motor is rotated at the second predetermined speed higher than the first predetermined speed and lower than the resonance generation speed, and a second-water-draining where the motor is rotated at a third predetermined speed higher than the second predetermined speed and lower than the resonance generation speed.

7. The method for a spinning cycle in a washing machine of 6, wherein the laundry-balancing is performed before performing the first/second-water-draining, and the first-water-draining is performed once after the laundry-balancing and the second-water-draining is repeatedly performed at least twice after the laundry-balancing.

8. The method for a spinning cycle in a washing machine of 1, further comprising:

a step of sensing an amount of motor unbalance during the water-draining, and a step of stopping the spinning cycle if the amount of motor unbalance is more or less than a predetermined allowable range.

9. The method for a spinning cycle in a washing machine of 1, further comprising steps of:

repeatedly performing the water-draining predetermined times more than at least twice;

sensing an amount of motor unbalance whenever the water-draining is performed;

calculating an average value of the amount of motor unbalance after the predetermined times; and stopping the spinning cycle if the average value is more or less than the predetermined allowable range.

10. The method for a spinning cycle in a washing machine of 1, wherein the second spinning speed is higher than the first spinning speed.

* * * * *